United States Patent [19]

Edgerton

[11] Patent Number: 4,829,619

[45] Date of Patent: May 16, 1989

[54] LID OPENING TOOL

[76] Inventor: Preston Edgerton, 810 N. Ave., Newport News, Va. 23605

[21] Appl. No.: 155,129

[22] Filed: Feb. 11, 1988

[51] Int. Cl.[4] ..... B67B 7/44

[52] U.S. Cl. ..... 7/156; 81/3.09; 81/3.55; 30/400

[58] Field of Search ..... 7/151, 152, 156, 161; 81/3.07, 3.09, 3.55, 3.57; 30/2, 400, 456

[56] References Cited

U.S. PATENT DOCUMENTS

| | | | |
|---|---|---|---|
| 692,045 | 1/1902 | Bacon | 81/3.09 X |
| 1,618,304 | 2/1927 | Nachtigal | 81/3.55 X |
| 4,234,988 | 11/1980 | Ross et al. | 7/151 |
| 4,492,132 | 1/1985 | Obey | 7/151 X |
| 4,580,302 | 4/1986 | Barth | 81/3.09 X |
| 4,747,173 | 5/1988 | Marcean | 81/3.09 X |

*Primary Examiner*—Frank T. Yost
*Assistant Examiner*—Michael D. Folkerts
*Attorney, Agent, or Firm*—Niles, Webner, Kurz & Bergert

[57] ABSTRACT

A tool for removing tight fitting lids from bulk containers including a rigid shaft, a knife assembly mounted on one end of the shaft on one side thereof, and a lifting hook mounted on the same end of the shaft, but on the opposite side thereof. A handle is attached perpendicularly to the other end of the shaft.

9 Claims, 1 Drawing Sheet

LID OPENING TOOL

BACKGROUND OF THE INVENTION

This invention relates generally to tools for removing tight fitting lids on plastic bulk containers, such as 5-gallon buckets for paint or the like. Tools of this nature are known generally in the prior art as emplified by U.S. Pat. No. 4,234,988 and 4,492,132. However, a need exists for and the invention is directed to a novel, compact, easy-to-handle, and safe tool for cutting, spreading, and lifting a plastic lid off a bucket.

SUMMARY OF THE INVENTION

Accordingly, a primary object of the invention resides in the provision of a novel tool for removing lids from plastic bulk containers.

Another object of the invention resides in the provision of the above novel tool which is rigid, compact, easy-to-handle, and safe to use.

Still another object of the invention resides in the provision of such a novel tool which has a rigid shaft, a knife assembly including a cutting blade and spreader element fixed on one side of the shaft, and a lid lifting hook formed on the opposite side of the shaft.

A further object of the invention resides in the provision of the above novel tool including a hand grip mounted perpendicularly on the upper end of the shaft to facilitate the application of a substantial upward pulling force against a lid.

Still other objects and advantages of the invention will become apparent upon reading the following detailed description of the invention with reference to the accompanying drawings wherein like numerals denote like elements.

DETAILED DESCRIPTION OF THE INVENTION

Figure 1:
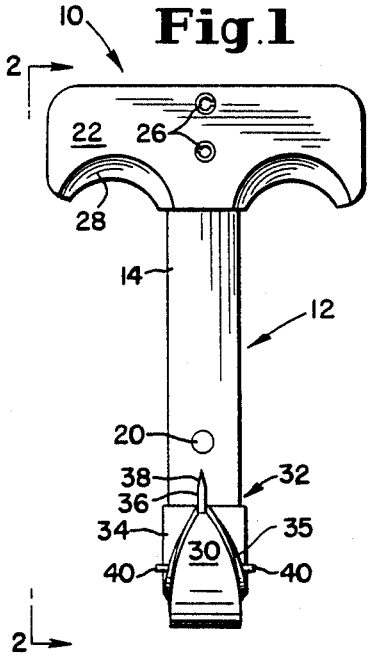
FIG. 1 is a front elevation view of the novel tool of the invention.
Figure 2:
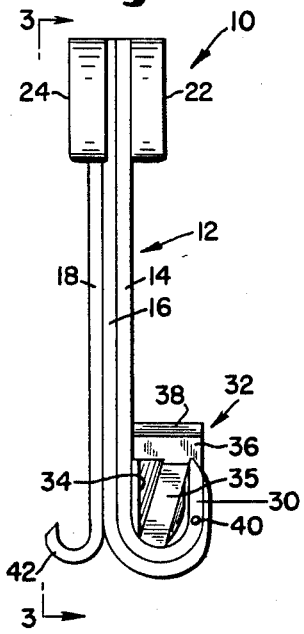
FIG. 2 is an end elevation view taken along line 2—2 of FIG. 1.
Figure 3:
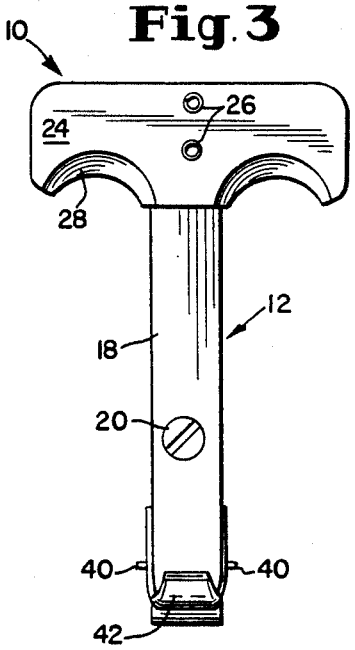
FIG. 3 is a rear elevation view taken along line 3—3 of FIG. 2.

Referring now to the drawings, tool 10 comprises a rigid aluminum vertical shaft 12 formed by front strip 14, center strip 16, and back strip 18 secured together by fastener 20. A pair of handle-forming flat bars 22 and 24 are fixed perpendicularly to the upper end of shaft 12 via roll pins 26 and are provided with finger groove 28 to facilitate gripping.

The bottom ends of front strip 14 and center strip 16 are rolled back in U-shaped fashion to form a short vertical leg 30 on the front side of shaft 12. Knife assembly 32 includes mounting block 34 fixed within the space between leg 30 and strip 14 and a cutting blade 36 projecting upwardly from block 34, the blade having a sharpened edge 38. As viewed in FIG. 1, leg 30 and the adjacent section 35 of block 34 taper outwardly and downwardly in expanding fashion from blade 36 so as to spread the cut section of the lid simultaneously with the cutting action of blade 36. Pins 40 project laterally from leg 30 at the enlarged base of the taper to engage the bottom of the lid following the cutting action and exert a lifting force.

The bottom end of back strip 18 is also rolled back in U-shaped fashion, but in a direction opposite that of strips 14 and 16 to form a lifting hook 42 on the backside of shaft 12.

Figure 4:
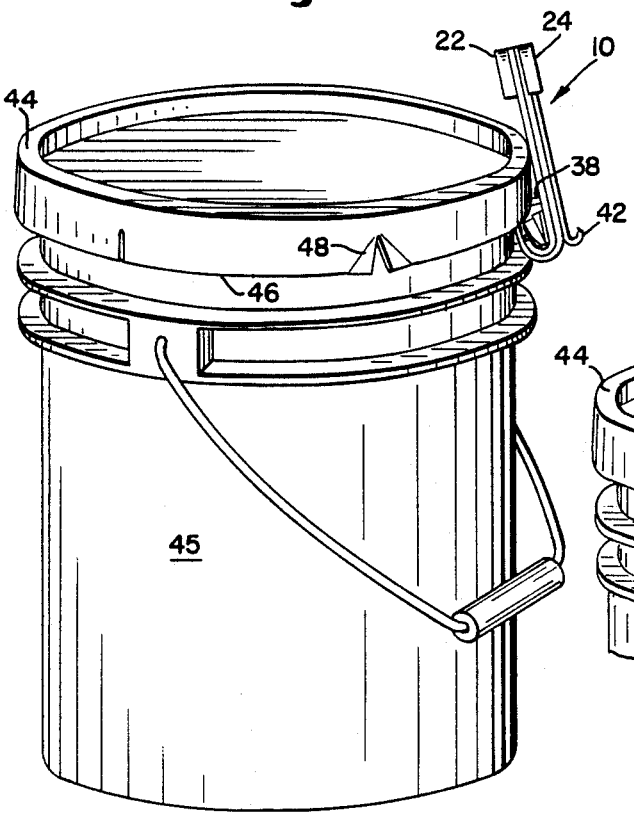
FIG. 4 is a fragmentary perspective view of the tool illustrating the knife assembly as it cuts through and spreads a rim section of a lid.

Operation of tool 10 will now be described with reference to FIGS. 4 and 5. To remove plastic lid 44 from bucket 45, the lid must first be severed in several places. Tool 10 is positioned with knife assembly 32 underneath bottom lip 46 and then pulled upwardly so that blade 36 cuts through the lip and the cut section of the lip is substantially simultaneously spread open by the taper formed on block section 35 and leg 36. Pins 40 then engage lip 46 to exert a lifting force on the lid as the tool is pulled upwardly.

Figure 5:
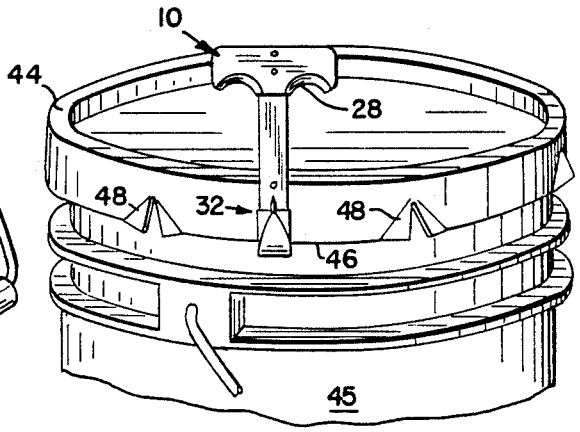
FIG. 5 is a fragmentary perspective view of the tool illustrating the lifting hook pulling the lid off a bucket.

When a sufficient number of cuts 48 have been made, as shown in FIG. 5, tool 10 is reversed and lifting hook 42 is engaged under lip 46 and pulled upwardly, this being done at several places around the periphery of the lid to free it from the bucket.

From the description hereinabove, it is apparent that tool 10 of the invention is very compact and rigid in construction, easy and safe to use, and effective in removing tight fitting lids. The rigid shaft and perpendicular handle enable a person to apply a substantial upward force to first cut the lid using the knife side of the tool and then remove the lid using the lifting hook side.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A tool for removing a lid from a bucket comprising vertical rigid shaft means having upper and lower ends, a knife assembly mounted at said lower end of said shaft means and disposed on one side thereof, said knife assembly including a cutting edge extending generally horizontally with respect to said shaft means and facing upwardly towards said upper end, lifting hook means mounted at said lower end of said shaft means on the opposite side thereof, and facing upwardly towards said upper end, whereby said cutting edge is first pulled upwardly through the lid in a vertical direction along said shaft means and the shaft means is then turned around so that said hook means is then pulled upwardly against said lid in a vertical direction to lift the lid from the bucket.

2. A tool according to claim 1, said knife assembly including a knife blade on which said cutting edge is formed and tapered means expanding downwardly from said blade, whereby as said shaft assembly is pulled upwardly said blade cuts said lid and said tapered means spreads the cut section open to facilitate removal of the lid.

3. A tool according to claims 1 or 2, said shaft means comprising front and back vertical strip means secured together, the lower end of said front strip means being formed in U-shaped fashion to provide a vertical leg and a space between said leg and said front strip means, said knife assembly being fixed within said space, and the lower end of said back strip means being formed in U-shaped fashion in a direction opposite that of said front strip means to provide said lifting hook means.

4. A tool according to claim 2, comprising handle means attached perpendicularly to the other end of said shaft means.

5. A tool according to claim 3, comprising handle means attached perpendicularly to the other end of said shaft means.

6. A tool according to claim 2, comprising pin means projecting laterally adjacent the base of said tapered means to engage and lift against the bottom of the lid.

7. A tool according to claim 3, comprising pin means projecting laterally adjacent the base of said tapered means to engage and lift against the bottom of the lid.

8. A tool according to claim 4, comprising pin means projecting laterally adjacent the base of said tapered means to engage and lift against the bottom of the lid.

9. A tool according to claim 5, comprising pin means projecting laterally adjacent the base of said tapered means to engage and lift against the bottom of the lid.

* * * * *